US012270547B2

(12) United States Patent
Chon

(10) Patent No.: US 12,270,547 B2
(45) Date of Patent: Apr. 8, 2025

(54) COMBUSTOR NOZZLE, COMBUSTOR, AND GAS TURBINE INCLUDING SAME

(71) Applicant: DOOSAN ENERBILITY CO., LTD., Changwon-si (KR)

(72) Inventor: Mu Hwan Chon, Changwon (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/057,269

(22) Filed: Nov. 21, 2022

(65) Prior Publication Data

US 2023/0243503 A1 Aug. 3, 2023

(30) Foreign Application Priority Data

Jan. 28, 2022 (KR) ..... 10-2022-0013236

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC ..... F23R 3/286; F23R 3/14
See application file for complete search history.

(56) References Cited

U.S. PATENT DOCUMENTS 5,101,633 A * 4/1992 Keller ..... F23C 7/004 60/737
5,235,814 A * 8/1993 Leonard ..... F23R 3/283 60/738
7,513,098 B2 * 4/2009 Ohri ..... F23R 3/14 60/737
8,312,722 B2 * 11/2012 York ..... F23D 14/62 60/737

(Continued)

FOREIGN PATENT DOCUMENTS

CN 212362096 U 1/2021
CN 212537915 U 2/2021

(Continued)

OTHER PUBLICATIONS

EP EESR, dated Jun. 12, 2023.
KR NOA, dated Sep. 18, 2023.
EP OA, dated Jan. 8, 2024.

*Primary Examiner* — Ted Kim
(74) *Attorney, Agent, or Firm* — Harvest IP Law, LLP

(57) ABSTRACT

A combustor nozzle including nozzle modules, a combustor, and a gas turbine including the same are proposed. The nozzle module includes a fuel supply pipe having an internal fuel flow path, manifolds communicating with the fuel supply pipe and arranged in a row in a radial direction so that air inlet flow paths are respectively formed at positions therebetween, and fuel mixers disposed along a circumferential direction at the rear side of the manifold to receive the fuel from the manifold and inject the fuel, each of the (Continued)

plurality of fuel mixers including a mixer body having one end communicating with the manifold, wherein a tip is formed at the other end of the mixer body, a shroud disposed to surround an outer circumferential surface of the mixer body to guide an airflow, and at least one fuel port formed through the mixer body to inject fuel.

19 Claims, 10 Drawing Sheets

(56) References Cited

U.S. PATENT DOCUMENTS

| | | | | |
|---|---|---|---|---|
| 8,572,981 | B2 * | 11/2013 | Bunker | F23D 14/48 60/748 |
| 9,163,839 | B2 | 10/2015 | Westmoreland | |
| 9,651,259 | B2 | 5/2017 | Boardman | |
| 9,759,425 | B2 | 9/2017 | Westmoreland | |
| 2003/0010032 | A1 | 1/2003 | Stuttaford | |
| 2004/0060301 | A1 | 4/2004 | Chen | |
| 2005/0252217 | A1 | 11/2005 | Chen | |
| 2010/0077760 | A1 | 4/2010 | Laster | |
| 2011/0016866 | A1 * | 1/2011 | Boardman | F23R 3/36 60/730 |
| 2011/0076628 | A1 * | 3/2011 | Miura | F23R 3/343 431/12 |
| 2013/0086910 | A1 * | 4/2013 | Khan | F23R 3/14 60/737 |
| 2013/0104556 | A1 * | 5/2013 | Uhm | F23R 3/002 60/722 |
| 2014/0075949 | A1 | 3/2014 | Prociw | |
| 2014/0109587 | A1 * | 4/2014 | Crothers | F02C 7/24 60/725 |
| 2014/0157779 | A1 * | 6/2014 | Uhm | F23R 3/10 60/725 |
| 2015/0167981 | A1 | 6/2015 | Woods et al. | |
| 2016/0033133 | A1 | 2/2016 | Johnson | |
| 2016/0146469 | A1 | 5/2016 | Lum | |
| 2017/0074521 | A1 | 3/2017 | Horikawa | |
| 2017/0276370 | A1 | 9/2017 | Christian | |
| 2018/0128489 | A1 * | 5/2018 | Boardman | F23R 3/10 |
| 2020/0072466 | A1 * | 3/2020 | Akiyama | F23R 3/286 |
| 2021/0010674 | A1 | 1/2021 | Thariyan | |
| 2021/0325046 | A1 * | 10/2021 | Lin | F23R 3/286 |

FOREIGN PATENT DOCUMENTS

| | | | |
|---|---|---|---|
| EP | 2189720 | A1 | 5/2010 |
| EP | 3073198 | A1 | 9/2016 |
| JP | H0517356 | A | 1/1993 |
| JP | 2564022 | B2 | 12/1996 |
| JP | 2759722 | B2 | 5/1998 |
| JP | 2011-075271 | A | 4/2011 |
| JP | 2012-032147 | A | 2/2012 |
| JP | 2013-253769 | A | 12/2013 |
| JP | 2014-173837 | A | 9/2014 |
| JP | 2014173841 | A | 9/2014 |
| JP | 2014196899 | A | 10/2014 |
| JP | 2016080214 | A | 5/2016 |
| JP | 5948489 | B2 | 6/2016 |
| JP | 2020-79685 | A | 5/2020 |
| JP | 2021169913 | A | 10/2021 |
| KR | 20210133023 | A | 11/2021 |
| WO | 2012001141 | A1 | 1/2012 |

* cited by examiner

COMBUSTOR NOZZLE, COMBUSTOR, AND GAS TURBINE INCLUDING SAME

CROSS REFERENCE TO RELATED APPLICATION

The present application claims priority to Korean Patent Application No. 10-2022-0013236, filed on Jan. 28, 2022, the entire contents of which are incorporated herein for all purposes by this reference.

BACKGROUND OF THE INVENTION

1. Field of the Invention

The present disclosure relates to a combustor nozzle, a combustor, and a gas turbine and, more particularly, to a combustor nozzle including a plurality of nozzle modules, a combustor, and a gas turbine including the same.

2. Description of the Background Art

A gas turbine is a combustion engine in which a mixture of air compressed by a compressor and fuel is combusted to produce a high temperature gas, which drives a turbine. The gas turbine is used to drive electric generators, aircraft, ships, trains, or the like.

The gas turbine generally includes a compressor, a combustor, and a turbine. The compressor serves to intake external air, compress the air, and transfer the compressed air to the combustor. The compressed air compressed by the compressor has a high temperature and a high pressure. The combustor serves to mix compressed air from the compressor and fuel and combust the mixture of compressed air and fuel to produce combustion gases, which are discharged to the gas turbine. The combustion gases drive turbine blades in the turbine to produce power. The power generated through the above processes is applied to a variety of fields such as generation of electricity, driving of mechanical units, etc.

Fuel is injected through nozzles disposed in respective combustors, wherein the fuel includes gaseous fuel and liquid fuel. In recent years, in order to suppress the emission of carbon dioxide, use of hydrogen fuel or a fuel containing hydrogen is recommended.

However, since hydrogen has a high combustion rate, when such fuels are burned with a gas turbine combustor, the flame formed in the gas turbine combustor approaches and heats the structure of the gas turbine combustor, thereby degrading the reliability of the gas turbine combustor.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a combustor nozzle capable of improving mixing characteristics of fuel and air to minimize the generation of nitrogen oxide and increase flame stability, a combustor, and a gas turbine including the same.

In an aspect of the present disclosure, there is provided a combustor nozzle including a plurality of nozzle modules.

The nozzle module includes a fuel supply pipe, a plurality of manifolds, and a plurality of fuel mixers. The fuel supply pipe has an internal fuel flow path through which fuel flows from the front side to the rear side. The plurality of manifolds communicate with the fuel supply pipe and are arranged in a row in a radial direction so that air inlet flow paths are respectively formed at positions therebetween. The fuel mixer is disposed along the circumferential direction at the rear side of the manifold to receive the fuel from the manifold and injects the fuel. Each of the fuel mixers includes a mixer body, a shroud, and a fuel port. One end of the mixing body communicates with the manifold and a tip is formed at the other end. The shroud is disposed to surround an outer circumferential surface of the mixer body to guide an airflow. The fuel port is formed through the mixer body to inject fuel.

In an embodiment, the fuel port may include a first fuel port passing through the tip of the mixer body.

In an embodiment, the tip may be provided with an inclined portion formed on an edge thereof to be inclined toward one end of the mixer body.

In an embodiment, the fuel port may include at least one second fuel port passing through a lateral side of the mixer body.

In an embodiment, the second fuel port may be formed between the shroud and the tip in the axial direction of the mixer body.

In an embodiment, the second fuel port may be inclined in the axial direction of the mixer body.

In an embodiment, the second fuel port may be inclined in a circumferential direction of an outer peripheral surface of the mixer body.

In an embodiment, the second fuel port may be inclined toward the tip.

In an embodiment, the fuel port may further include a second fuel port formed on the lateral side of the mixer body.

In an embodiment, a swirling blade may be further disposed between the shroud and the outer peripheral surface of the mixer body to swirl an airflow.

In an embodiment, a strut may be further disposed between the shroud and the outer peripheral surface of the mixer body to support the shroud and the mixer body and to guide an airflow.

In an embodiment, the fuel port may include a third fuel port formed through the shroud in communication with the inside of the mixer body.

In an embodiment, the nozzle module may further include a branch pipe communicating with the fuel supply pipe and the plurality of manifolds and having an air inlet communicating with the air inlet flow path.

In an embodiment, the plurality of nozzle modules may be disposed along the circumferential direction to collectively form a circle as a whole, and the plurality of air inlet flow paths may be arranged in a concentric annular shape as a whole.

In an embodiment, the plurality of nozzle modules may be composed of a plurality of outer nozzle modules circumferentially arranged in an annular shape as a whole, and a central nozzle module disposed at the center on the inner side of the outer nozzle modules.

In an embodiment, the plurality of fuel mixers may be arranged in a generally fan shape in the outer nozzle module, and the plurality of fuel mixers may be arranged in a generally circular shape in the central nozzle module.

In another aspect of the present disclosure, there is provided a combustor including a combustor nozzle and a duct assembly. The combustor nozzle includes a plurality of nozzle modules. The duct assembly is coupled to one side of the combustor nozzle. In the duct assembly, fuel and air are combusted, and combustion gases are delivered to a turbine. The nozzle module includes a fuel supply pipe, a plurality of manifolds, and a plurality of fuel mixers. The fuel supply pipe has an internal fuel flow path through which fuel flows from the front side to the rear side. The plurality of manifolds communicate with the fuel supply pipe and are arranged in a row in a radial direction so that air inlet flow paths are respectively formed at positions therebetween. The fuel mixer is disposed along the circumferential direction at the rear side of the manifold to receive the fuel from the manifold and injects the fuel. Each of the plurality of fuel mixers includes a mixer body, a shroud, and a fuel port. One end of the mixing body communicates with the manifold and a tip is formed at the other end. The shroud is disposed to surround an outer circumferential surface of the mixer body to guide an airflow. The fuel port is formed through the mixer body to inject fuel.

In an embodiment, the duct assembly may include a liner having an internal combustion chamber, and the nozzle may further include a plurality of guide tubes coupled to the front end of the liner and into which the fuel mixers are respectively inserted.

In an embodiment, the shroud may be attached to an inner side of the guide tube.

In a further aspect of the present disclosure, there is provided a gas turbine including a compressor, a combustor, and a turbine. The compressor compresses air introduced from the outside. The combustor mixes the compressed air compressed in the compressor and fuel and combusts an air-fuel mixture. The turbine includes a plurality of turbine blades to be rotated by combustion gases combusted in the combustor. The combustor includes a combustor nozzle and a duct assembly. The combustor nozzle includes a plurality of nozzle modules. The duct assembly is coupled to one side of the combustor nozzle. In the duct assembly, the fuel and the air are combusted, and combustion gases are delivered to a turbine. The nozzle module includes a fuel supply pipe, a plurality of manifolds, and a plurality of fuel mixers. The fuel supply pipe has an internal fuel flow path through which the fuel flows from the front side to the rear side. The plurality of manifolds communicate with the fuel supply pipe and are arranged in a row in a radial direction so that air flow paths are respectively formed at positions therebetween. The fuel mixer is disposed along the circumferential direction at the rear side of the manifold to receive the fuel from the manifold and injects the fuel. Each of the plurality of fuel mixers includes a mixer body, a shroud, and a fuel port. One end of the mixing body communicates with the manifold and a tip is formed at the other end. The shroud is disposed to surround an outer circumferential surface of the mixer body to guide an airflow. The fuel port is formed through the mixer body to inject fuel.

According to the combustor nozzle, the combustor, and the gas turbine including the same, the plurality of nozzle modules each including the plurality of fuel mixers each having the mixer body and the shroud are provided so that the mixing characteristics of fuel and air are advantageously improved to minimize the generation of nitrogen oxide and increase flame stability.

DETAILED DESCRIPTION OF THE INVENTION

Figure 1:
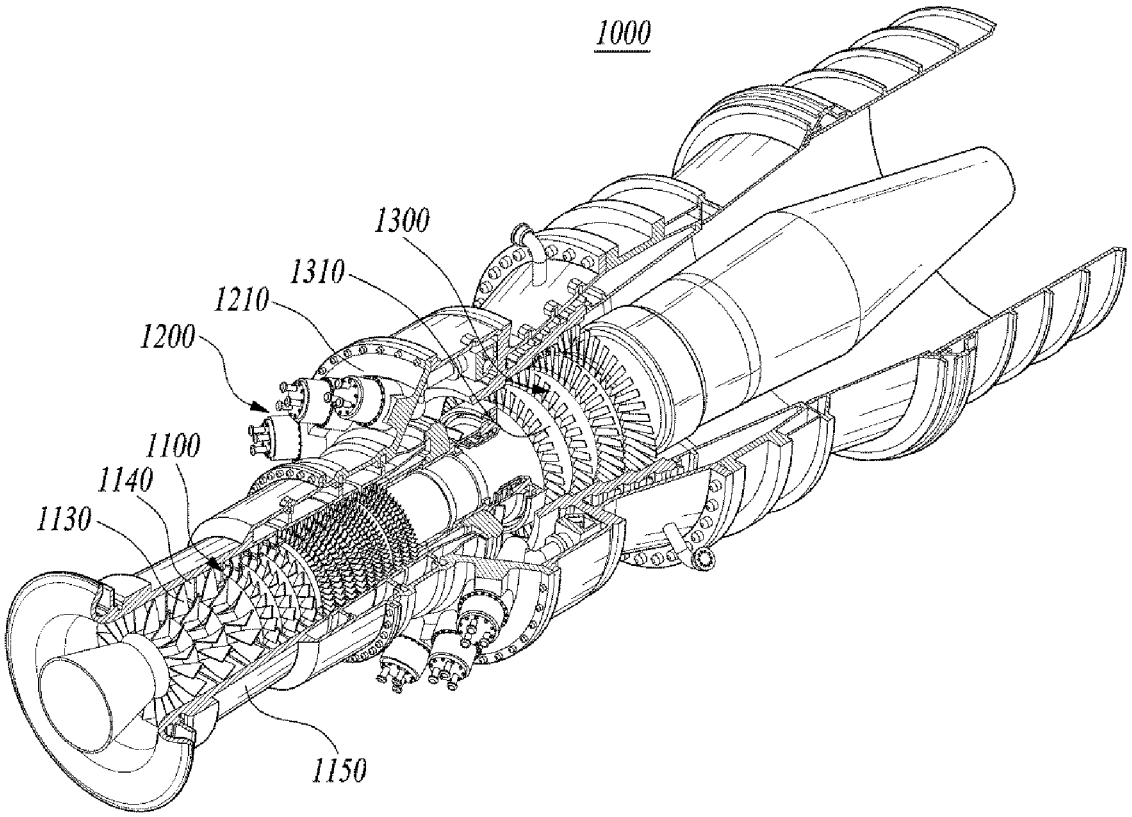
FIG. 1 is a view illustrating the interior of a gas turbine according to an embodiment of the present disclosure.

Hereinafter, exemplary embodiments of the present disclosure will be described in detail with reference to the accompanying drawings. However, it should be noted that the present disclosure is not limited thereto, but may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "comprising" or "including" specifies the presence of stated features, numbers, steps, operations, elements, parts, or combinations thereof, but does not preclude the presence or addition of one or more other features, numbers, steps, operations, elements, parts, or combinations thereof. Hereinafter, preferred embodiments of the present disclosure will be described in detail with reference to the accompanying drawings.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Hereinafter, a combustor nozzle, a combustor, and a gas turbine including the same according to the present disclosure will be described.

Figure 2:
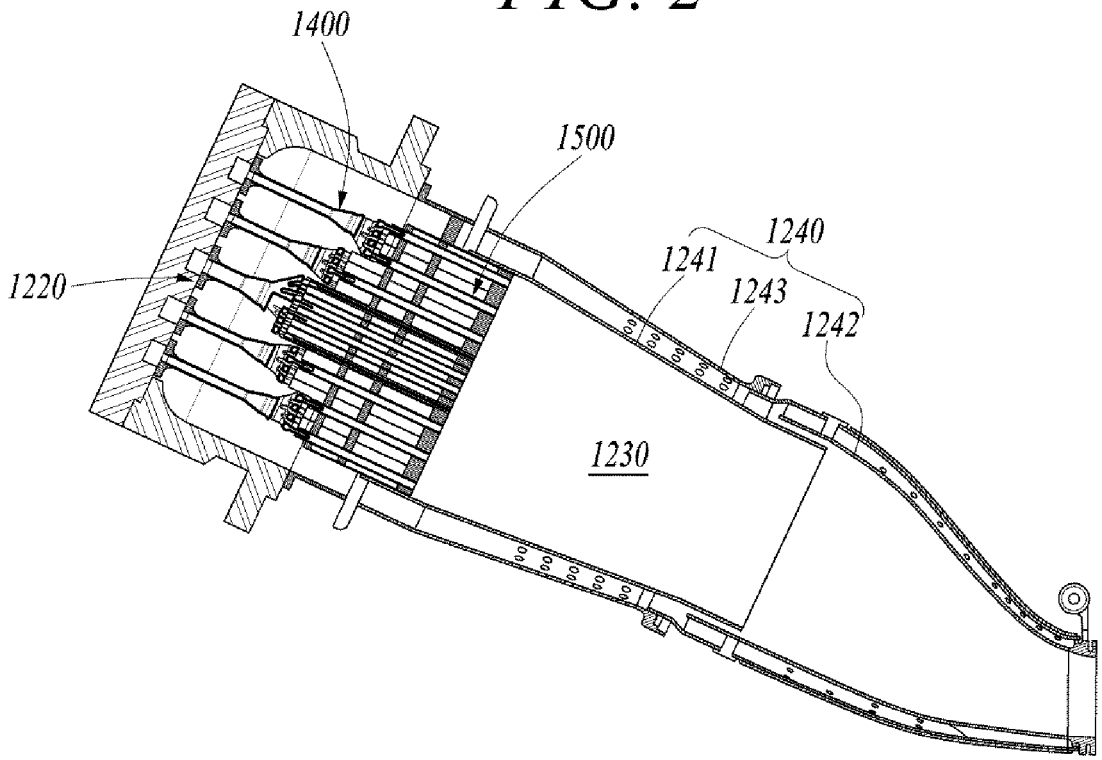
FIG. 2 is a sectional view illustrating a combustor of FIG. 1.

FIG. 1 is a view illustrating the interior of a gas turbine according to an embodiment of the present disclosure, and FIG. 2 is a view illustrating a combustor of FIG. 1.

The gas turbine will now be described with reference to FIGS. 1 and 2.

An ideal thermodynamic cycle of a gas turbine 1000 according to the present embodiment follows a Brayton cycle. The Brayton cycle consists of four thermodynamic processes: isentropic compression (adiabatic compression), isobaric combustion, isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

As illustrated in FIG. 1, the gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIG. 1, the compressor 1100 of the gas turbine 1000 may suck and compress air. The compressor 1100 may serve both to supply the compressed air by compressor blades 1130 to a combustor 1200 and to supply the cooling air to a high temperature region of the gas turbine 1000. Here, since the sucked air undergoes an adiabatic compression process in the compressor 1100, the air passing through the compressor 1100 has increased pressure and temperature.

The compressor 1100 is usually designed as a centrifugal compressor or an axial compressor, and the centrifugal compressor is applied to a small-scale gas turbine, whereas a multi-stage axial compressor is applied to a large-scale gas turbine 1000 illustrated in FIG. 1 since the large-scale gas turbine 1000 is required to compress a large amount of air. In this case, in the multi-stage axial compressor, the compressor blades 1130 of the compressor 1100 rotate according to the rotation of the rotor disks to compress the introduced air and move the compressed air to the compressor vanes 1140 on the rear stage. As the air passes through the compressor blades 1130 formed in multiple stages, the air is compressed to a higher pressure.

The compressor vanes 1140 are mounted inside the housing 1150 in stages. The compressor vanes 1140 guide the compressed air moved from the front side compressor blades 1130 toward the rear-side compressor blades 1130. In one embodiment, at least some of the compressor vanes 1140 may be mounted so as to be rotatable within a predetermined range for adjustment of an air inflow, or the like.

The compressor 1100 may be driven using a portion of the power output from the turbine 1300. To this end, as illustrated in FIG. 1, the rotary shaft of the compressor 1100 and the rotary shaft of the turbine 1300 may be directly connected. In the case of the large scale gas turbine 1000, almost half of the output produced by the turbine 1300 may be consumed to drive the compressor 1100. Accordingly, improving the efficiency of the compressor 1100 has a direct effect on improving the overall efficiency of the gas turbine 1000.

The turbine 1300 includes a rotor disk 1310 and a plurality of turbine blades and turbine vanes radially disposed on the rotor disk 1310. The rotor disk 1310 has a substantially disk shape on which a plurality of grooves is formed. The grooves are formed to have curved surfaces, and turbine blades and turbine vanes are inserted into the grooves. The turbine vanes are fixed against rotation and guide a flow of combustion gases through the turbine blades. The turbine blades are rotated by combustion gases to generate rotational force.

On the other hand, the combustor 1200 serves to mix the compressed air supplied from an outlet of the compressor 1100 with fuel and combust the mixture at constant pressure to produce hot combustion gases. FIG. 2 illustrates an example of the combustor 1200 provided in the gas turbine 1000. The combustor 1200 may include a combustor casing 1210, nozzles 1220, and a duct assembly 1240.

The combustor casing 1210 may have a substantially circular cylindrical shape in which the nozzles 1220 are surrounded. The nozzle 1220 is disposed downstream of the compressor 1100 and may be disposed along the annular combustor casing 1210. Each nozzle 1220 is provided with at least one nozzle module 1400, through which fuel and air are mixed in an appropriate ratio and injected to achieve a suitable state for combustion.

The gas turbine 1000 may use a gas fuel, in particular, a fuel containing hydrogen. The fuel may include a hydrogen fuel alone or a fuel containing hydrogen and natural gas.

The duct assembly is provided to connect the nozzles 1220 and the turbine 1300 so that the hot combustion gas flows therethrough to heat the duct assembly, whereas the compressed air flows towards the nozzles 1220 along an outer surface of the duct assembly 1240, thereby properly cooling the heated duct assembly 1240.

The duct assembly 1240 may include a liner 1241 and a transition piece 1242, and a flow sleeve 1243. The duct assembly 1240 has a double structure in which the flow sleeve 1243 surrounds the outside of the liner 1241 and the transition piece 1242, so that compressed air penetrates into an annular space inside the flow sleeve 1243 to cool the liner 1241 and the transition piece 1242.

The liner 1241 is a tube member connected to the nozzles 1220 of the combustor 1200, wherein an internal space of the liner 1241 defines the combustion chamber 1230. A longitudinal one side of the liner 1241 is coupled to the nozzle 1220, and the other side of the liner 1241 is coupled to the transition piece 1242.

The transition piece 1242 is connected an inlet of the turbine 1300 to guide the hot combustion gas toward the turbine 1300. A longitudinal one side of the transition piece 1242 is coupled to the liner 1241, and the other side of the transition piece 1242 is coupled to the turbine 1300. The flow sleeve 1243 serves to protect the liner 1241 and the transition piece 1242 while avoiding direct exhaust of hot air to the outside.

Figure 3:
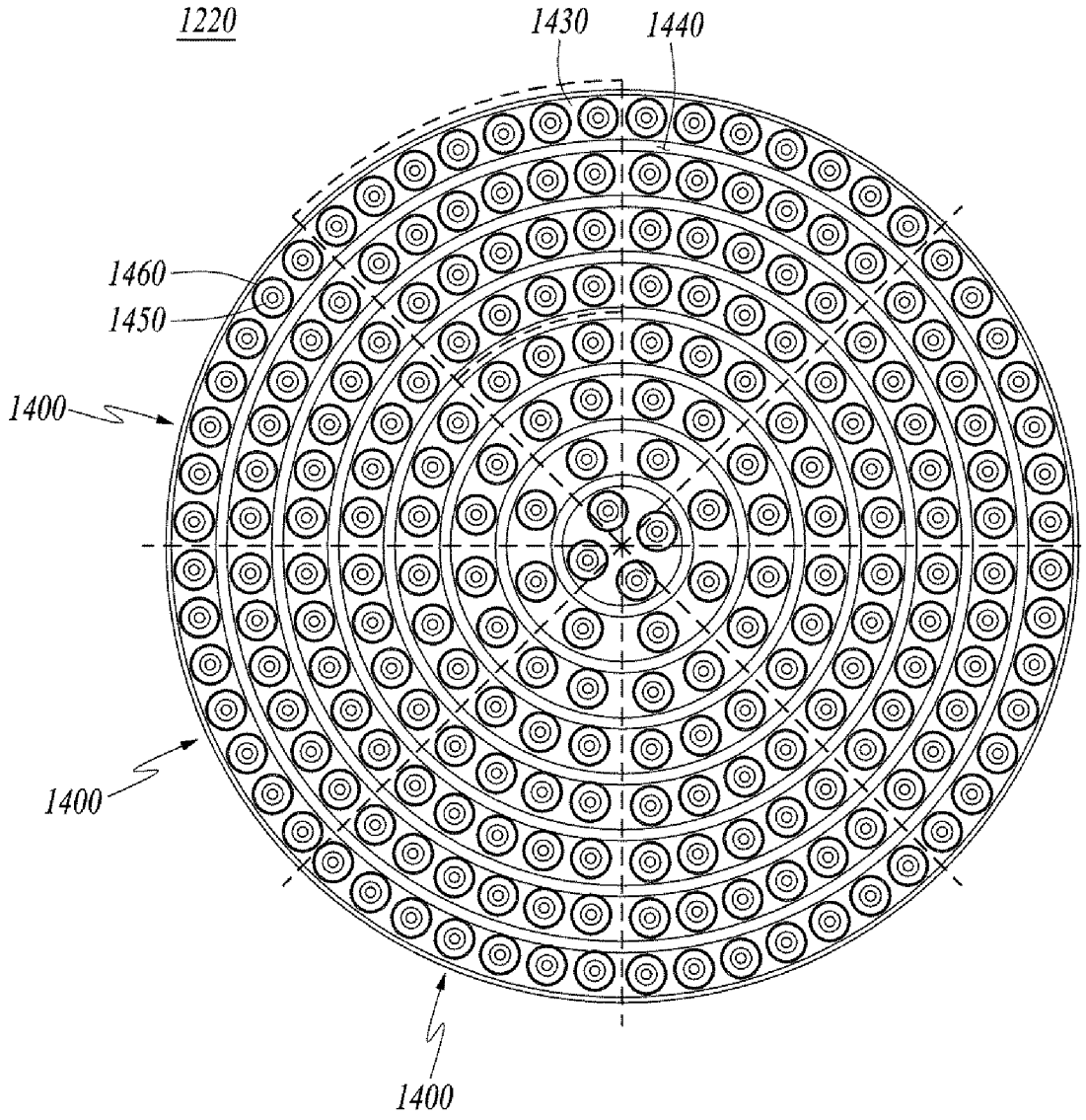
FIG. 3 is a front view illustrating a combustor nozzle according to a first embodiment of the present disclosure.
Figure 4:
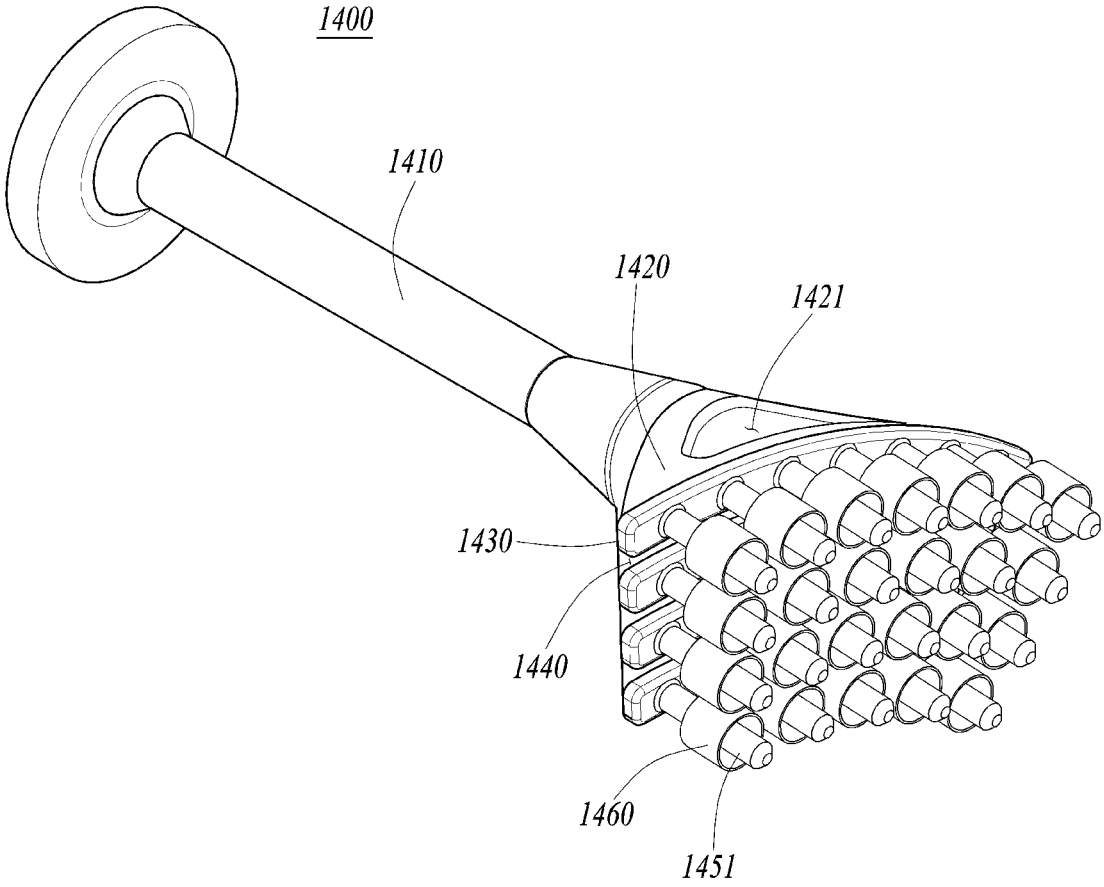
FIG. 4 is a perspective view illustrating a nozzle module according to a first embodiment of the present disclosure.
Figure 5:
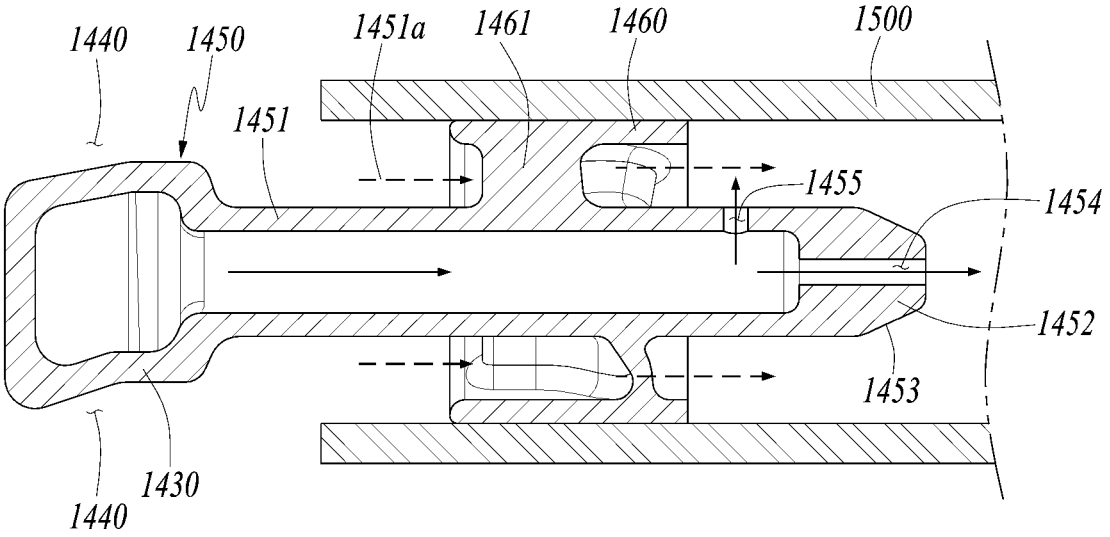
FIG. 5 is a sectional view illustrating a fuel mixer of the nozzle module according to the first embodiment of the present disclosure.

FIG. 3 is a front view illustrating a combustor nozzle according to a first embodiment of the present disclosure, FIG. 4 is a perspective view illustrating a nozzle module according to a first embodiment of the present disclosure, and FIG. 5 is a sectional view illustrating a fuel mixer of the nozzle module according to the first embodiment of the present disclosure.

Hereinafter, the combustor nozzle 1220 according to the first embodiment of the present disclosure will be described in detail with reference to FIGS. 3 to 5. The combustor nozzle 1220 according to the first embodiment of the present disclosure includes a plurality of nozzle modules 1400. The nozzle module 1400 includes a fuel supply pipe 1410, a plurality of manifolds 1430, and a plurality of fuel mixers 1450.

According to an embodiment, the fuel supply pipe 1410 is a tubular member for supplying fuel. A fuel flow path is formed in the fuel supply pipe 1410 so that fuel flows from the front side to the rear side therethrough. A flange (not shown) may be disposed at a front end of the fuel supply pipe 1410 so that fuel may be introduced into the front end of the fuel supply pipe 1410 through the flange (not shown). An extension (not shown) may be disposed at a rear end of the fuel supply pipe 1410. The extension is a portion in which a flow cross-sectional area increases toward the rear end. When the extension (not shown) is disposed, there is an advantage in that the flow resistance during flowing of fuel toward the manifold 1430 to be described later is reduced.

According to an embodiment, a plurality of manifolds 1430 is disposed at the rear end of the fuel supply pipe 1410 such that the manifolds are in communication with the rear end of the fuel supply pipe 1410. The plurality of manifolds 1430 are provided to communicate with one fuel supply pipe 1410. The manifolds 1430 are arranged in a row in a radial direction. In addition, an air inlet flow path 1440 is formed between the manifolds 1430. The manifolds 1430 may be formed in a fan shape or an annular shape, so the air inlet flow paths 1440 formed between the manifolds 1430 may also be formed in an annular shape.

According to an embodiment, a branch pipe 1420 may be further disposed between the fuel supply pipe 1410 and the plurality of manifolds 1430. The branch pipe 1420 is configured to allow one fuel supply pipe 1410 to communicate with the plurality of manifolds 1430. The branch pipe 1420 has a front end communicating with the fuel supply pipe 1410, and a rear end branching from the front end to communicate with the plurality of manifolds 1430.

According to an embodiment, an air inlet (opening) 1421 may be formed in the branch pipe 1420. The air inlet 1421 may be formed so as to be opened at a lateral side of the branch pipe 1420. Although the air inlet 1421 is illustrated as being formed in the upper side of the branch pipe 1420 in FIG. 4, this is only an example of the air inlet 1421, and the position of the air inlet 1421 is not limited thereto. The air inlet 1421 of the branch pipe 1420 may communicate with the air inlet flow paths 1440 formed between the plurality of manifolds 1430. In the duct assembly 1240, compressed air flowing in an inner annular space of the flow sleeve 1243 may be introduced into the air inlet 1421 of the branch pipe 1420, and then flow through the air inlet flow paths 1440.

According to an embodiment, a plurality of fuel mixers 1450 are disposed on the manifolds 1430. The fuel mixers 1450 may be disposed along the circumferential direction on one manifold 1430. As a result, in one nozzle 1220, the plurality of fuel mixers 1450 may be disposed along the radial and circumferential directions. As such, when the plurality of fuel mixers 1450 are disposed with respect to one fuel supply pipe 1410, there is an advantage in that the structure is simplified and the fuel mixers 1450 can be easily assembled, disassembled, and inspected.

According to an embodiment, the fuel mixer 1450 includes a mixer body 1451, a shroud 1460, and fuel ports 1454 and 1455. One end of the mixer body 1451 communicates with the manifold 1430, and at the other end a tip 1452 is formed. The mixer body 1451 has an internal flow path longitudinally extending from one side to the other side and through which fuel flows. The one end and the one side of the mixer body 1451 may be referred to as the front end/the forward end/the upstream end and the front side/the forward side/the upstream side of the mixer body 1451, respectively, whereas the other end and the other side of the mixer body 1451 may be referred to as the back end/the rearward end/the downstream end and the back side/the rearward side/the downstream side of the mixer body 1451, respectively, throughout this specification. Fuel having passed sequentially through the fuel supply pipe 1410 and the manifold 1430 is introduced into the one end of the mixer body 1451 and then injected to the outside of the mixer body 1451 through fuel ports 1454 and 1455, which will be described later.

According to an embodiment, a shroud 1460 is disposed on the outside of the mixer body 1451. On the outside of the mixer body 1451, an air flow path 1451*a* through which air introduced through the air inlet flow path 1440 flows may be formed. At least a part of the air flow path 1451*a* may be formed between the mixer body 1451 and the shroud 1460. The shroud 1460 may be disposed on the air flow path 1451*a* to guide air to smoothly flow toward the other side of the mixer body 1451. A bell mouth (not shown) may be formed at a front end of the shroud 1460 for a smooth inflow of air.

According to an embodiment, the shroud 1460 may be disposed to surround an outer peripheral surface of the mixer body 1451. The shroud 1460 may be formed to extend along the longitudinal direction of the mixer body 1451, and may be disposed to be spaced apart from the mixer body 1451. A swirling blade 1461 may be further disposed between the shroud 1460 and the outer peripheral surface of the mixer body 1451. The swirling blade 1461 may swirl air flowing between the shroud 1460 and the mixer body 1451. The plurality of swirling blades 1461 may be provided in an inclined manner to swirl air. The swirling blade 1461 may extend from the mixer body 1451 to the shroud 1460 to not only swirl air, but also support a portion between the shroud 1460 and the mixer body 1451.

According to an embodiment, the least one fuel port 1454 and/or 1455 may be formed in the mixer body 1451. The fuel ports 1454 and 1455 inject fuel in the mixer body 1451 to the outside. Fuel injected to the outside is mixed with air. The fuel ports 1454 and 1455 may include at least one of a first fuel port 1454 and a second fuel port 1455.

According to an embodiment, the first fuel port 1454 may be formed at the tip 1452 of the mixer body 1451. The first fuel port 1454 is formed through the tip 1452 to communicate with the inside and the outside of the mixer body 1451. The first fuel port 1454 may be formed through the tip 1452 in the longitudinal direction of the mixer body 1451. Accordingly, fuel in the mixer body 1451 may be longitudinally injected to the outside of the mixer body 1451 through the first fuel port 1454.

According to an embodiment, an inclined portion 1453 may be formed at an edge of the tip 1452. The inclined portion 1453 may be inclined toward the one end, the front end, of the mixer body 1451 from the edge of the tip 1452. The inclined portion 1453 may be formed to extend from the tip 1452 to the outer peripheral surface of the mixer body 1451, and may have a straight or curved cross-section.

Without the inclined portion 1453, a low-speed region or a recirculation region of the air flow from the air flow path 1451*a* may be formed on the rear side of the tip 1452. In other words, when the cross-sectional shape of the tip 1452 is formed in the form of a bluff or a sharp edge with a cliff-shaped portion, air guided by the shroud 1460 may flow or recirculate at a low speed around the cliff-shaped portion. When a flame is backfired, the flame may be attached to the low-speed region or the recirculation region, so the nozzle module 1400 may be damaged. When the inclined portion 1453 is formed on the tip 1452, the formation of the low-speed region or the recirculation region can be minimized, so that the above-described flame attachment can be avoided. Meanwhile, since the first fuel port 1454 pushes any the low-speed region or the recirculation region that may remain toward the rear side when injecting fuel, the above-described flame attachment can be further avoided.

According to an embodiment, the second fuel port 1455 may be formed on a lateral side of the mixer body 1451. The second fuel port 1455 may be formed through the mixer body 1451 from the lateral side of the mixer body 1451. At least one second fuel port may be provided. According to an embodiment, a plurality of second fuel ports 1455 may be disposed along the longitudinal direction of the mixer body 1451. In addition, the plurality of fuel mixtures may also be disposed along the circumferential direction of the mixer body 1451. Accordingly, fuel in the mixer body 1451 may be injected to the outside of the mixer body through the second fuel port 1455, and the injection direction may intersect the longitudinal direction of the mixer body 1451.

According to an embodiment, the second fuel port 1455 may be disposed between the shroud 1460 and the tip 1452 in the axial direction of the mixer body 1451. Air having passed through the air inlet flow path 1440 is smoothly guided through the air flow path 1451*a* to the other side, i.e., the rear side, of the mixer body 1451 while passing through the shroud 1460. Accordingly, it is preferable, according to an embodiment, that the second fuel port 1455 is disposed between the shroud 1460 and the tip 1452 and fuel is injected into the previously smoothly guided air flow, thereby increasing mixing degree of air and fuel.

In addition, according to an embodiment, the second fuel port 1455 may be disposed to be spaced apart from the shroud 1460 in the axial direction of the mixer body 1451. By way of this configuration, fuel may be injected into air after the air is sufficiently guided by the shroud 1460, so that the degree of mixing between the air and the fuel may be further increased.

According to an embodiment, the second fuel port 1455 may be formed to be inclined in the circumferential direction from the outer peripheral surface of the mixer body 1451. The second fuel port 1455 may be formed to be inclined in the circumferential direction with respect to a radial direction, when the radial direction is defined as a direction from the center of the mixing body 1451 toward the outside or a reverse direction thereof. In this case, a flow of fuel injected from the second fuel port 1455 may be swirled outside the mixer body 1451, and accordingly, the degree of mixing between air and fuel may increase.

According to an embodiment, the second fuel port 1455 may be formed to be inclined toward the tip 1452 from the outer peripheral surface of the mixer body 1451. The second fuel port 1455 may be formed to be inclined in the axial downstream direction with respect to the radial direction, when the radial direction is defined as above described. In this case, a flow of fuel injected from the second fuel port 1455 may be injected at a higher speed toward the tip 1452, thereby minimizing the flame backfire.

Meanwhile, according to an embodiment, a plurality of guide tubes 1500 may be further disposed in bundles in the nozzle 1220. The guide tube 1500 may be coupled to a front end of the liner 1241 of the duct assembly 1240. The guide tube 1500, in particular, a downstream end of the guide tube 1500, may communicate with the combustion chamber 1230. The plurality of guide tubes 1500 may be provided in a number corresponding to that of the plurality of fuel mixers 1450, and each of the fuel mixers 1450 may be respectively coupled to each of the guide tubes 1500 in a one-to-one correspondence relationship. The air-fuel mixture mixed by the fuel mixer 1450 may be guided to the combustion chamber 1230 along the guide tube 1500, and may be further mixed while flowing in the guide tube 1500. The length of the guide tube 1500 may be determined and adjusted in consideration of the possibility of and the size of the backfire of a flame generated in the combustion chamber 1230 and the mixing degree of air and fuel.

According to an embodiment, each of the fuel mixers 1450 may be respectively inserted into one of the guide tubes 1500. In this case, the shroud 1460 of the fuel mixer 1450 may be inserted into the guide tube 1500, and the outer diameter of the shroud 1460 may correspond to the inner diameter of the guide tube 1500. When the shroud 1460 is fitted and inserted into the guide tube 1500, air passing through the shroud 1460 may flow wholly in a space between the shroud 1460 and the mixer body 1451. The air flow path 1451*a* may be disposed between he guide tube 1500 and the mixer body 1451. According to an embodiment, the shroud 1460 is inserted into the guide tube 1500, the front end or the bell mouth (not shown) of the shroud 1460 may be disposed at the same position as the front end of the guide tube 1500.

In addition, according to an embodiment, the fuel mixer 1450 may be attached and coupled to the inner side of the guide tube 1500. Even in this case, the shroud 1460 may be attached to the inner side of the guide tube 1500, and the whole air passing through the shroud 1460 flows in the space between the shroud 1460 and the mixer body 1451. In addition, the shroud 1460 and the guide tube 1500 may stably support each other.

In the meantime, in the combustor nozzle 1220 according to the first embodiment of the present disclosure, a plurality of nozzle modules 1400 may be disposed along the circumferential direction, forming, collectively, a circular shape as a whole. That is, the plurality of nozzle modules 1400 are arranged so that the front surface of the combustor nozzle 1220 may be formed in a circular shape. In addition, a plurality of air inlet flow paths 1440 of each of nozzle modules 1400 may be arranged to form an annular flow path in the nozzle 1220. At this time, the front side of the nozzle module 1400 may be formed in form of a sector or a sector whose center is cut.

In addition, as the nozzle 1220 is composed of a plurality of nozzle modules 1400, there is an advantage in that the nozzle 1220 can be manufactured in various sizes and shapes and the nozzle 1220 can be easily assembled, disassembled, and inspected. In addition, since the plurality of nozzle modules 1400 can be controlled individually or in groups, there is an advantage in that the nozzle can be operated in various combustion modes.

Figure 6:
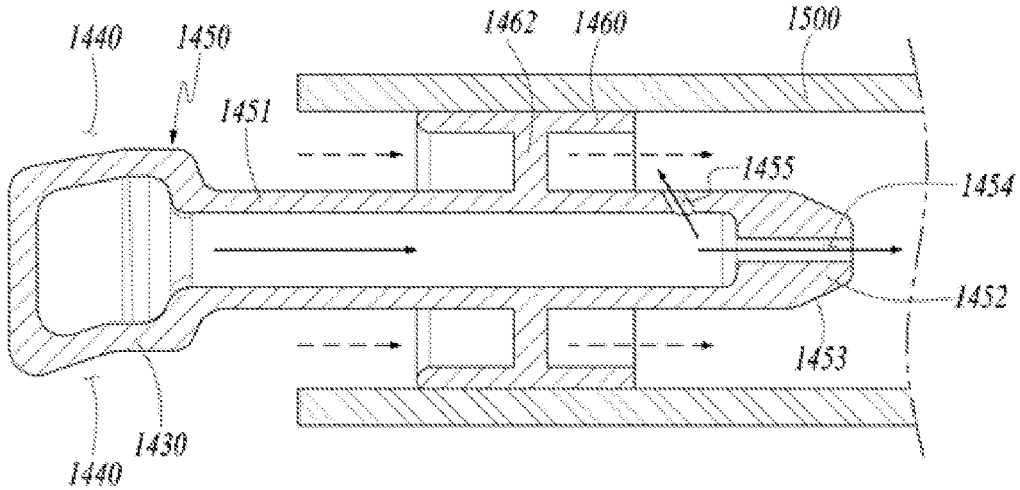
FIG. 6 is a sectional view illustrating a fuel mixer of a nozzle module according to a second embodiment of the present disclosure.

FIG. 6 is a sectional view illustrating a fuel mixer 1450 of a nozzle module 1400 according to a second embodiment of the present disclosure.

Hereinafter, a combustor nozzle 1220 according to a second embodiment of the present disclosure will be described in detail with reference to FIG. 6. The combustor nozzle 1220 according to the second embodiment of the present disclosure is the same as the combustor nozzle 1220 according to the first embodiment of the present disclosure, except for a shroud 1460 and related components, so a redundant description thereof will be omitted.

In the combustor nozzle 1220 according to the second embodiment of the present disclosure, a strut 1462 may be further disposed on the mixer body 1451. The strut 1462 may be disposed between the shroud 1460 and the outer peripheral surface of the mixer body 1451 to support the shroud and the mixer body and to guide an airflow. The plurality of struts 1462 may be formed in a rod shape, and may be disposed to be spaced apart from each other in the circumferential direction on the outer peripheral surface of the mixer body 1451.

According to an embodiment, the strut 1462 is disposed between the shroud 1460 and the mixer body 1451, the shroud 1460 may be more stably and firmly coupled to the mixer body 1451. According to an embodiment, the strut 1462 may be formed only thin enough to support the shroud 1460. In this case, there is an advantage of minimizing the flow resistance of air passing through the shroud 1460. In addition, this allows air passing through the shroud 1460 to flow straight so that the air may flow at a faster speed on the outer peripheral surface of the mixer body 1451.

Figure 7:
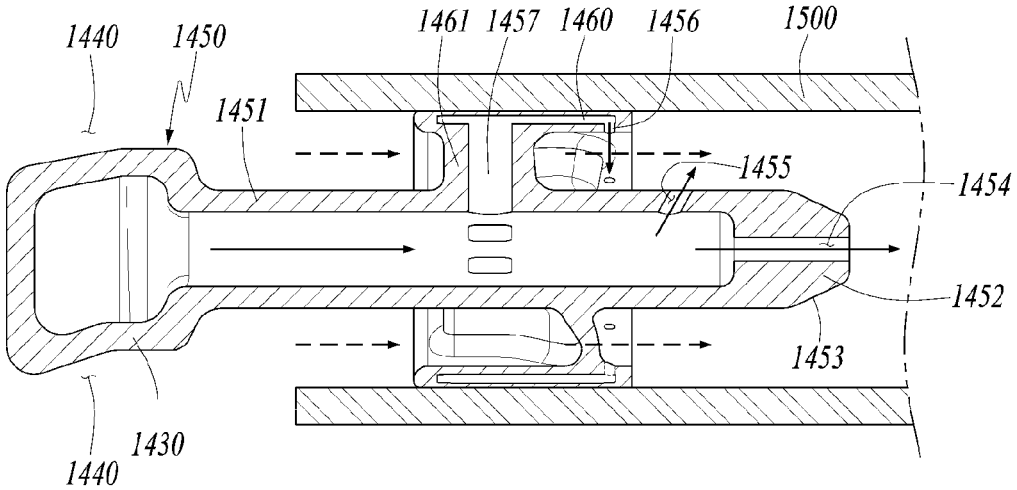
FIG. 7 is a sectional view illustrating a fuel mixer of a nozzle module according to a third embodiment of the present disclosure.

FIG. 7 is a sectional view illustrating a fuel mixer of a nozzle module according to a third embodiment of the present disclosure.

Hereinafter, a combustor nozzle 1220 according to a third embodiment of the present disclosure will be described in detail with referenced to FIG. 7. The combustor nozzle 1220 according to the third embodiment of the present disclosure is the same as the combustor nozzle 1220 according to the first or second embodiment of the present disclosure, except for a third fuel port 1456 and related components, so a redundant description thereof will be omitted.

In the combustor nozzle 1220 according to the third embodiment of the present disclosure, at least one third fuel port 1456 may be formed. The third fuel port 1456 may be formed through the shroud 1460 to communicate with the interior of the mixer body 1451. As the third fuel port 1456 is formed, the mixing degree of air and fuel may be further improved.

According to an embodiment, the third fuel port 1456 may be formed through an inner peripheral surface of the shroud 1460. A fuel plenum 1457 to be filled with fuel may be formed inside the shroud 1460. The fuel plenum 1457 may extend to the inside of the mixer body 1451 and the third fuel port 1456 in a fluid-communication manner with them.

According to an embodiment, when the swirling blade 1461 is disposed on the shroud 1460, the fuel plenum 1457 may be formed through the swirling blade 1461. Although not shown in FIG. 7, when the strut 1462 is disposed on the shroud 1460, the fuel plenum 1457 may be formed through the strut 1462.

According to an embodiment, the third fuel port 1456 may be disposed close to the rear end of the shroud 1460. In this case, the third fuel port 1456 may be disposed on the rear side of the swirling blade 1461 or the strut 1462.

According to an embodiment, the plurality of third fuel ports 1456 may be provided. The plurality of third fuel ports 1456 may be disposed along the longitudinal and/or circumferential directions in the shroud 1460. Also, the third fuel port 1456 may be inclined in the longitudinal and/or circumferential direction of the shroud 1460.

According to an embodiment, the fuel plenum 1457 may be formed through both the swirling blade 1461 and the shroud 1460, communicating with the interior of the mixer body 1451 and the third fuel port 1456. The fuel plenum 1457 may be further extended in the shroud 1460 along the axial direction. The fuel plenum 1457 may be extended in the shroud 1460 along the axially forward direction and/or the axially rearward direction. The third fuel port 1457 may be formed at the rearward end of the fuel plenum 1457 extended rearward direction. According to an embodiment, the third fuel port 1457 may be formed with an outlet toward the inward direction from the outside such that the fuel injected from the third fuel port 1457 is injected inwardly toward the mixer body 1451 from the shroud 1460.

Figure 8:
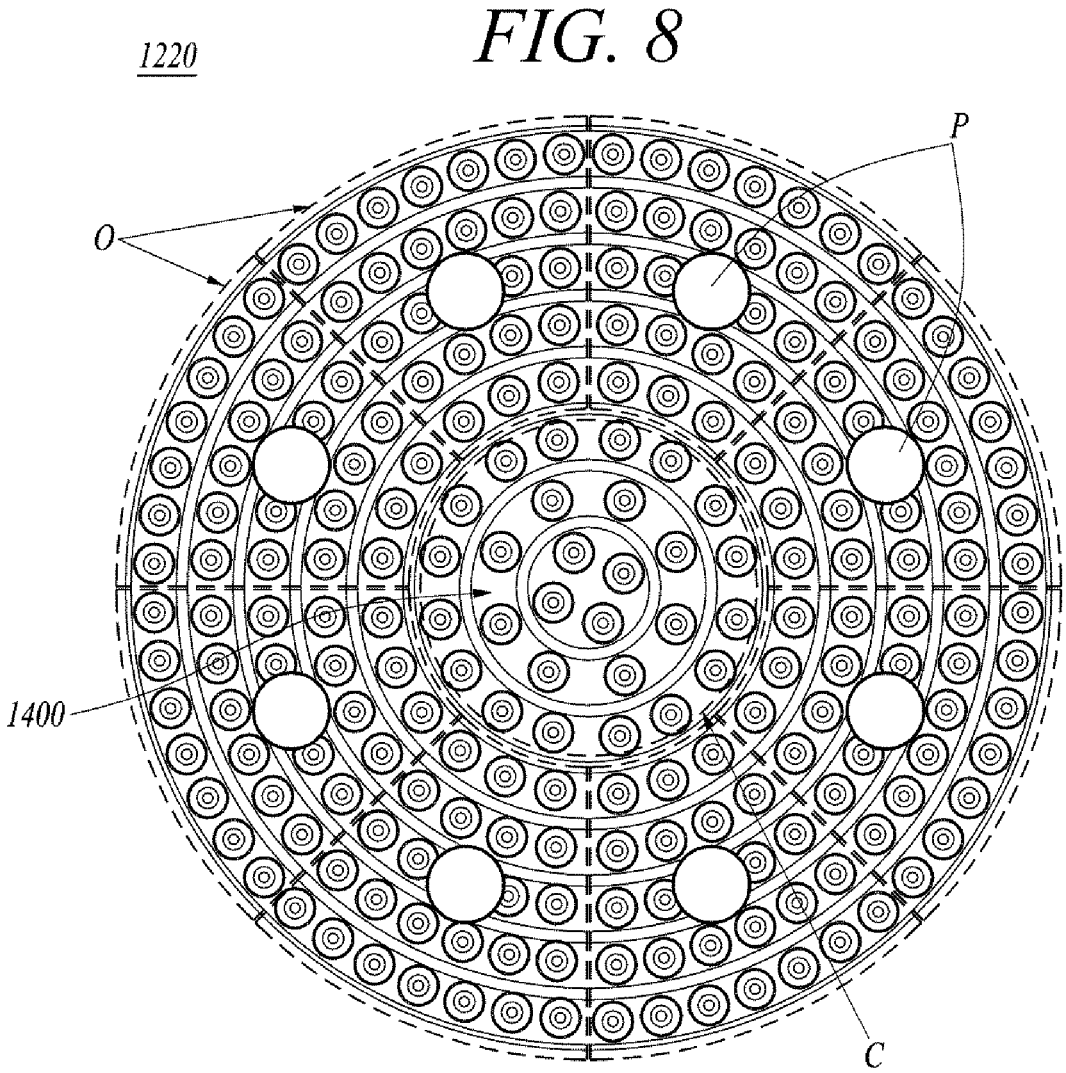
FIG. 8 is a front view illustrating a combustor nozzle according to a fourth embodiment of the present disclosure.
Figure 9:
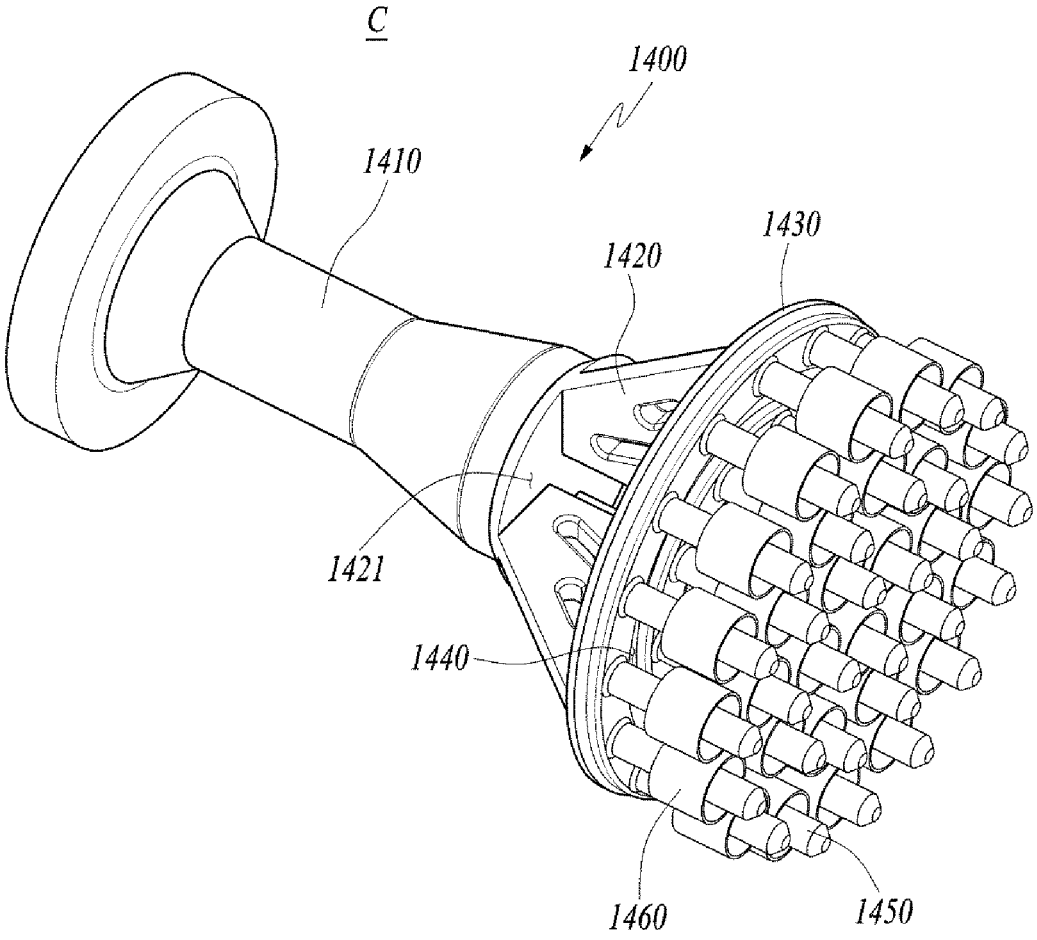
FIG. 9 is a perspective view illustrating a central nozzle module according to the fourth embodiment of the present disclosure.
Figure 10:
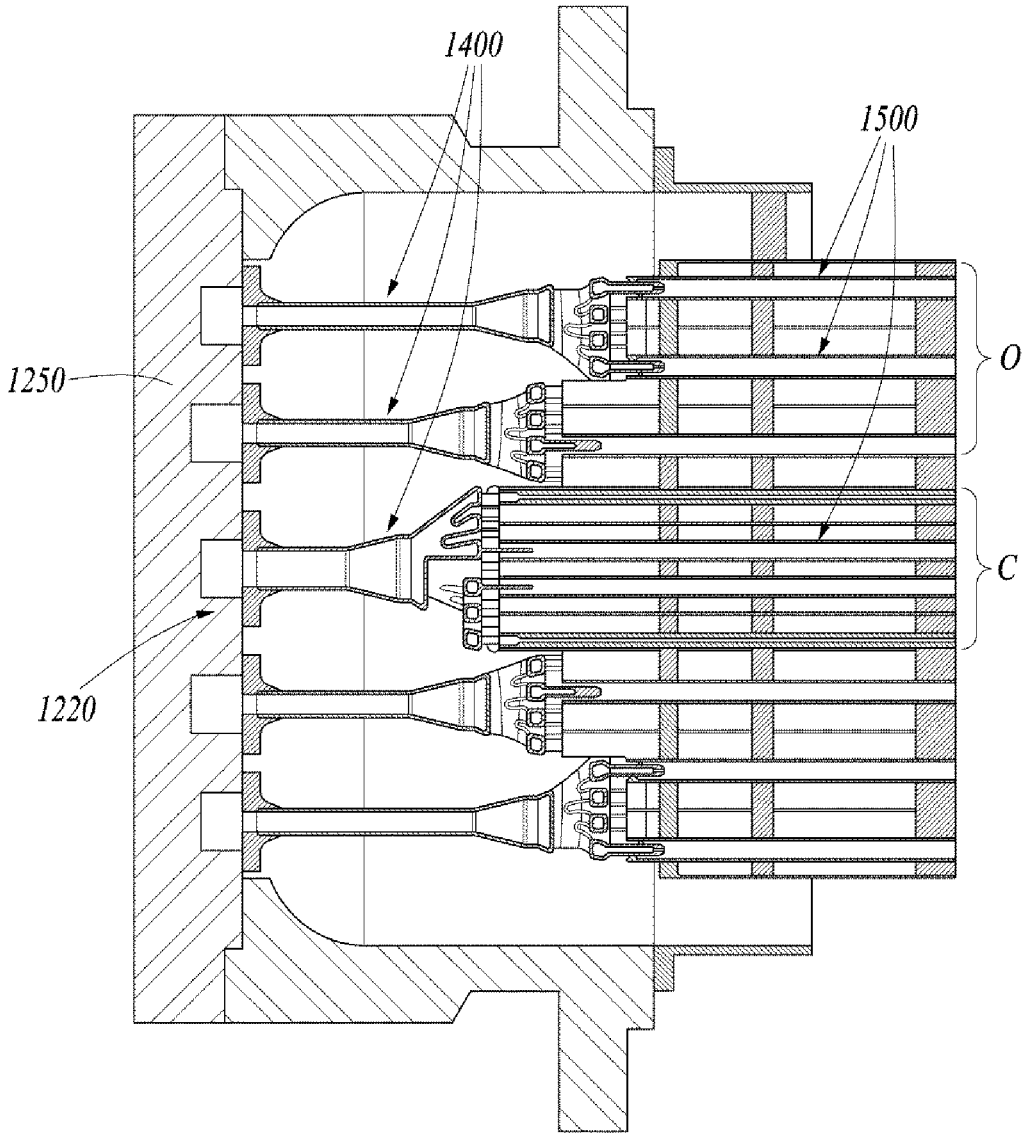
FIG. 10 is a sectional view illustrating the combustor nozzle according to the fourth embodiment of the present disclosure.

FIG. 8 is a front view illustrating a combustor nozzle 1220 according to a fourth embodiment of the present disclosure, FIG. 9 is a perspective view illustrating a central nozzle module C according to the fourth embodiment of the present disclosure, and FIG. 10 is a cross-sectional view illustrating the combustor nozzle 1220 according to the fourth embodiment of the present disclosure.

Hereinafter, a combustor nozzle 1220 according to a fourth embodiment of the present disclosure will be described in detail with referenced to FIGS. 8 to 10. The combustor nozzle 1220 according to the fourth embodiment of the present disclosure is the same as the combustor nozzle 1220 according to the first embodiment of the present disclosure, except for a central nozzle module C and related components, so a redundant description thereof will be omitted.

In the combustor nozzle 1220 according to the fourth embodiment of the present disclosure, a plurality of nozzle modules 1400 are divided into an outer nozzle module O and a central nozzle module C. When the nozzle 1220 is viewed from the front, the outer nozzle module O is disposed outside the nozzle 1220, and the central nozzle module C is a nozzle module 1400 disposed at the center of the nozzle 1220 and the center on the inner side of the outer nozzle modules O.

In the outer nozzle module O, when viewed from the front, a plurality of fuel mixers 1450 are disposed in a fan shape as a whole. Specifically, in the outer nozzle module O, the plurality of fuel mixers 1450 are arranged in the shape of a sector whole central portion is cut off. When the plurality of outer nozzle modules O is disposed along the circumferential direction, the outer nozzle modules O, collectively, form an annular shape as a whole. In addition, although FIG. 10 illustrates that the outer nozzle module O is configured in one row in the radial direction, alternatively, the outer nozzle module may be configured in two or more rows. In this way, when the number of radial rows of the outer nozzle modules O is adjusted, there is an advantage that the size of the nozzle 1220 can be variously designed.

According to an embodiment, in the central nozzle module C disposed at the center of the annular shape formed by the outer nozzle modules O, when viewed from the front, the plurality of fuel mixers 1450 may be disposed in a circular shape as a whole. Accordingly, a plurality of manifolds 1430 of the central nozzle module C may be formed in an annular shape, and a plurality of air inlets 1421 of the branch pipe 1420 may also be uniformly formed along the circumferential direction.

According to an embodiment, a pilot burner module P may be disposed on at least one of the outer nozzle module O and the central nozzle module C. The pilot burner module P is a configuration for starting the nozzle 1220, and may be disposed at the center of the outer nozzle module O or the central nozzle module C in order to improve startability and control combustion vibration. In some cases, the pilot burner module P may be configured in the same manner as the nozzle module 1400, or may be configured in a premixed swirling flame method, a diffusion flame method, or a torch method.

According to an embodiment, the fuel mixers 1450 disposed in the central nozzle module C may be disposed further forward than the fuel mixers 1450 disposed in the outer nozzle modules O. The nozzle 1220 may further include an end cover 1250. Flanges (not shown) may be respectively disposed at the front ends of the fuel supply pipes 1410 of the central nozzle module C and the outer nozzle modules O, and each flange (not shown) may be coupled to the end cover 1250. Accordingly, each of the flanges (not shown) may be disposed on the same plane on the end cover 1250. According to an embodiment, in this case, the length of the fuel supply pipe 1410 of the central nozzle module C may be shorter than that of the fuel supply pipe 1410 of the outer nozzle modules O. When the outer nozzle modules O are composed of a plurality of circumferential rows, the length of each fuel supply pipe 1410 may be gradually lengthened from the inner side toward the outer side.

The air having passed through the flow sleeve 1243 is diverted near the end cover 1250 and is supplied to the nozzle 1220. The air from the sleeve 143 flows from the outer side toward the inner side, in other words, from the side of the outer nozzle modules O disposed on the outer side toward the side of the central nozzle module C disposed on the inner side. At this time, when the length of the fuel supply pipe 1410 of the central nozzle module C is shorter than the length of the outer nozzle module O, the air supplied to the central nozzle module C may flow smoothly without being disturbed by the outer nozzle module O, so that the air flow can be uniformly supplied to each of the nozzle modules 1400. As a result, the concentration deviation of fuel and air in each fuel mixer 1450 can be minimized.

While the embodiments of the present disclosure have been described, it will be apparent to those skilled in the art that various modifications and variations can be made in the present disclosure through addition, change, omission, or substitution of components without departing from the spirit of the invention as set forth in the appended claims, and such modifications and changes may also be included within the scope of the present disclosure. Also, it is noted that any one feature of an embodiment of the present disclosure described in the specification may be applied to another embodiment of the present disclosure.

The invention claimed is:

1. A combustor nozzle comprising a plurality of nozzle modules, each nozzle module comprising:

a fuel supply pipe having an internal fuel flow path through which fuel flows from an upstream side to a downstream side based on a flow direction of the fuel in the internal fuel flow path;

a plurality of manifolds communicating with the fuel supply pipe, parallelly extending in a circumferential direction, and arranged in a row in a radial direction, wherein there are at least three manifolds in the plurality of manifolds; and for each of the plurality of manifolds, a plurality of fuel mixers, disposed along the circumferential direction at the downstream side of a respective manifold, receives the fuel from the respective manifold and injects the fuel, wherein each of the plurality of fuel mixers comprising:

a mixer body having one end communicating with the respective manifold, wherein a tip is formed at an opposite end of the mixer body;

a shroud disposed to surround an outer circumferential surface of the mixer body to guide an airflow; and at least one fuel port formed through the mixer body to inject fuel, wherein each of the plurality of manifolds has a radially inner end surface and a radially outer end surface, wherein the radially outer end surface of each manifold from among the plurality of manifolds and the radially inner end surface of an adjacent manifold from among the plurality of manifolds, which is radially adjacent to the each manifold, forms a space therebetween, such that each space between radially adjacent manifolds from among the plurality of the manifolds forms an air inlet flow path, wherein the plurality of nozzle modules is composed of a plurality of outer nozzle modules circumferentially arranged in an annular shape as a whole and a central nozzle module disposed at a center on an inner side of the outer nozzle modules, wherein each of the plurality of manifolds included in each of the outer nozzle modules has a concentric arc shape, while each of the plurality of manifolds included in the central nozzle module has a concentric annular shape.

2. The combustor nozzle according to claim 1, wherein the fuel port includes a first fuel port passing through the tip of the mixer body.

3. The combustor nozzle according to claim 2, wherein the tip is provided with an inclined portion formed on an edge thereof to be inclined toward one end of the mixer body.

4. The combustor nozzle according to claim 1, wherein the fuel port includes at least one second fuel port passing through a lateral side of the mixer body.

5. The combustor nozzle according to claim 4, wherein the second fuel port is formed between the shroud and the tip in the axial direction of the mixer body.

6. The combustor nozzle according to claim 4, wherein the second fuel port is inclined in the axial direction of the mixer body.

7. The combustor nozzle according to claim 4, wherein the second fuel port is inclined toward the tip.

8. The combustor nozzle according to claim 1, wherein a swirling blade is further disposed between the shroud and the outer circumferential surface of the mixer body to swirl an airflow.

9. The combustor nozzle according to claim 1, wherein a strut is further disposed between the shroud and the outer circumferential surface of the mixer body to support the shroud and the mixer body and to guide an airflow.

10. The combustor nozzle according to claim 1, wherein each fuel mixer further includes a third fuel port formed through the shroud in communication with the inside of the mixer body.

11. The combustor nozzle according to claim 1, wherein each nozzle module further comprises a branch pipe communicating with the fuel supply pipe and the plurality of manifolds and having an air inlet communicating with the air inlet flow path.

12. The combustor nozzle according to claim 1, wherein the plurality of outer nozzle modules is disposed along the circumferential direction to collectively form a circle as a whole, and a plurality of air inlet flow paths is arranged in a concentric annular shape as a whole.

13. The combustor nozzle according to claim 1, wherein the plurality of fuel mixers included in each of the plurality of outer nozzle modules is arranged in a generally fan shape, and the plurality of fuel mixers included in the central nozzle module is arranged in a generally circular shape.

14. The combustor nozzle according to claim 1, wherein the air inlet flow path formed between the adjacent manifolds from among the plurality of manifolds is formed in an annular shape or an arc shape.

15. The combustor nozzle according to claim 14, wherein the each space between the adjacent manifolds forming the air inlet flow path is open toward the downstream side based on a flow direction of the fuel in the internal fuel flow path such that an air is discharged from the inlet flow path between the adjacent manifolds and provided into the plurality of fuel mixers.

16. A combustor comprising a combustor nozzle comprising a plurality of nozzle modules, and a duct assembly coupled to one side of the combustor nozzle and in which fuel and air are combusted and combustion gases are delivered to a turbine, each nozzle module comprising:

a fuel supply pipe having an internal fuel flow path through which fuel flows from an upstream side to a downstream side based on a flow direction of the fuel in the internal fuel flow path;

a plurality of manifolds communicating with the fuel supply pipe, parallelly extending in a circumferential direction, and arranged in a row in a radial direction, wherein there are at least three manifolds in the plurality of manifolds; and for each of the plurality of manifolds, a plurality of fuel mixers, disposed along the circumferential direction at the downstream side of a respective manifold, receives the fuel from the respective manifold and injects the fuel, wherein each of the plurality of fuel mixers comprising:

a mixer body having one end communicating with the respective manifold, wherein a tip is formed at an opposite end of the mixer body;

a shroud disposed to surround an outer circumferential surface of the mixer body to guide an airflow; and at least one fuel port formed through the mixer body to inject fuel, wherein each of the plurality of manifolds has a radially inner end surface and a radially outer end surface, wherein the radially outer end surface of each manifold from among the plurality of manifolds and the radially inner end surface of an adjacent manifold from among the plurality of manifolds, which is radially adjacent to the each manifold, forms a space therebetween, such that each space between radially adjacent manifolds from among the plurality of the manifolds forms an air inlet flow path, wherein the plurality of nozzle modules is composed of a plurality of outer nozzle modules circumferentially arranged in an annular shape as a whole and a central nozzle module disposed at a center on an inner side of the outer nozzle modules, wherein each of the plurality of manifolds included in each of the outer nozzle modules has a concentric arc shape, while each of the plurality of manifolds included in the central nozzle module has a concentric annular shape.

17. The combustor according to claim 16, wherein the duct assembly includes a liner having an internal combustion chamber, and the nozzle further comprises a plurality of guide tubes coupled to the front end of the liner and into which the fuel mixers are respectively inserted.

18. The combustor according to claim 17, wherein the shroud is attached to an inner side of the guide tube.

19. A gas turbine comprising a compressor compressing air introduced from the outside, a combustor mixing the compressed air compressed in the compressor and fuel and combusting an air-fuel mixture, and a turbine including a plurality of turbine blades to be rotated by combustion gases combusted in the combustor, the combustor comprising a combustor nozzle comprising a plurality of nozzle modules, and a duct assembly coupled to one side of the combustor nozzle and in which the fuel and the air are combusted and combustion gases are delivered to the turbine, each nozzle module comprising:

a fuel supply pipe having an internal fuel flow path through which the fuel flows from an upstream side to a downstream side based on a flow direction of the fuel in the internal fuel flow path;

a plurality of manifolds communicating with the fuel supply pipe, parallelly extending in a circumferential direction, and arranged in a row in a radial direction, wherein there are at least three manifolds in the plurality of manifolds; and for each of the plurality of manifolds, a plurality of fuel mixers, disposed along the circumferential direction at the downstream side of a respective manifold, receives the fuel from the respective manifold and injects the fuel, wherein each of the plurality of fuel mixers comprising:

a mixer body having one end communicating with the respective manifold, wherein a tip is formed at an opposite end of the mixer body;

a shroud disposed to surround an outer circumferential surface of the mixer body to guide an airflow; and at least one fuel port formed through the mixer body to inject fuel, wherein each of the plurality of manifolds has a radially inner end surface and a radially outer end surface, wherein the radially outer end surface of each manifold from among the plurality of manifolds and the radially inner end surface of an adjacent manifold from among the plurality of manifolds, which is radially adjacent to the each manifold, forms a space therebetween, such that each space between radially adjacent manifolds from among the plurality of the manifolds forms an air inlet flow path, wherein the plurality of nozzle modules is composed of a plurality of outer nozzle modules circumferentially arranged in an annular shape as a whole and a central nozzle module disposed at a center on an inner side of the outer nozzle modules, wherein each of the plurality of manifolds included in each of the outer nozzle modules has a concentric arc shape, while each of the plurality of manifolds included in the central nozzle module has a concentric annular shape.

* * * * *